United States Patent [19]

Werk et al.

[11] Patent Number: 4,574,601

[45] Date of Patent: Mar. 11, 1986

[54] CLOSURE FOR VALISES OR THE LIKE WHICH IS PROVIDED WITH A PERMUTATION LOCK

[75] Inventors: Otto Werk, Langa, Denmark; Rudi H. Düringer, Wuppertal, Fed. Rep. of Germany

[73] Assignee: Cavalet ApS, Korsor, Denmark

[21] Appl. No.: 636,875

[22] Filed: Aug. 1, 1984

[30] Foreign Application Priority Data

Aug. 5, 1983 [DE] Fed. Rep. of Germany ..... 3328284

[51] Int. Cl.[4] ..... E05B 65/62

[52] U.S. Cl. ..... 70/70; 70/312

[58] Field of Search ..... 70/69, 70, 71, 72, 73, 70/74, 75, 76, 312; 190/101, 119, 120

[56] References Cited

U.S. PATENT DOCUMENTS

| | | | |
|---|---|---|---|
| 3,756,639 | 9/1973 | Wilkinson | 70/70 |
| 3,952,561 | 4/1976 | Bake | 70/70 |
| 4,094,392 | 6/1978 | Gregg | 190/41 R |
| 4,395,892 | 8/1983 | Remington | 70/312 |

FOREIGN PATENT DOCUMENTS

| | | |
|---|---|---|
| 361158 | 5/1976 | Austria . |
| 3038481 | 6/1982 | Fed. Rep. of Germany . |

*Primary Examiner*—Robert L. Wolfe

*Attorney, Agent, or Firm*—Martin A. Farber

[57] ABSTRACT

In a closure for a valise and the like, with hook latches on both sides of a central combination lock, the latches being displaceable by manual actuation into a release position, this displacement being locked, when the combination of the lock is not properly set, by a blocking part of the combination lock which is displaceable into the release position by spring action, a swing yoke surrounding the combination lock in U-shape and having central section and U-yoke arms with ends, each said end, respectively, having a pivot point, a manually actuatable single push key adjacent the combination lock, single push key comprising said central section of said swing yoke.

angle levers, each of said angle levers having a first arm and a second arm, each said first arm forming a hook swing latch, and respectively ones of said U-yoke arms, adjacent said pivot point, operatively acting upon said second arm of a respective said angle lever.

11 Claims, 8 Drawing Figures

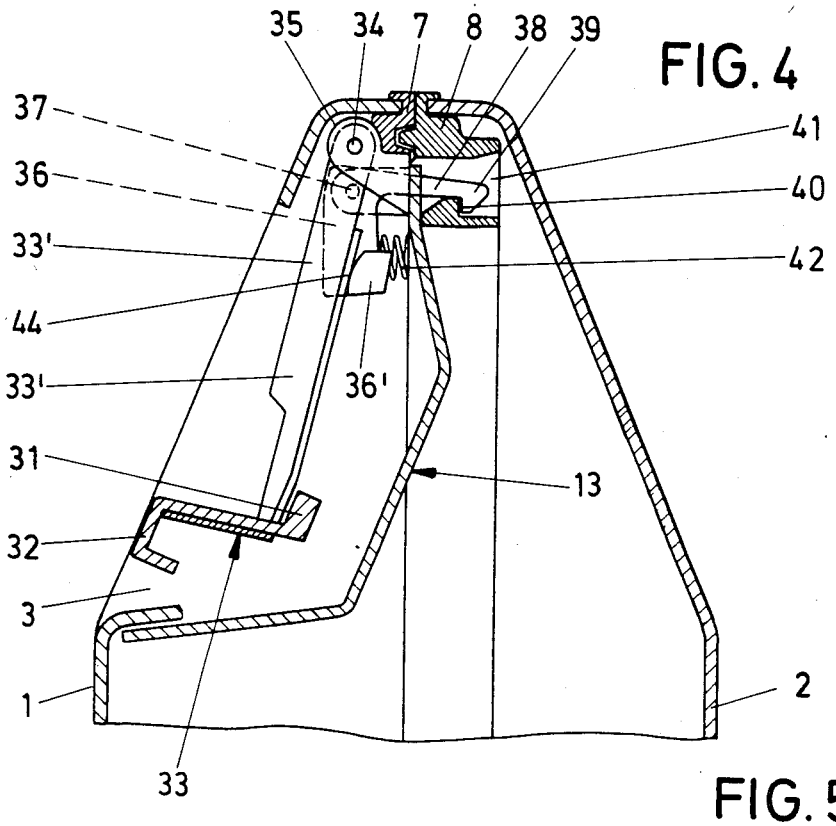
FIG. 4
FIG. 5
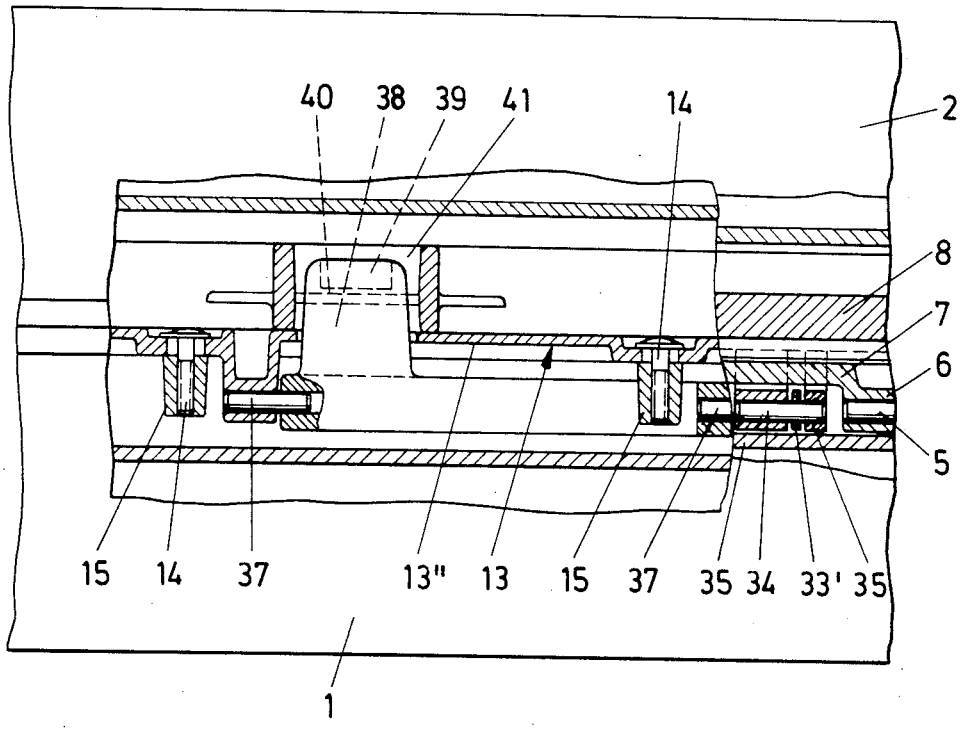

CLOSURE FOR VALISES OR THE LIKE WHICH IS PROVIDED WITH A PERMUTATION LOCK

FIELD AND BACKGROUND OF THE INVENTION

The present invention relates to a closure for valises or the like, with hook latches arranged on both sides of a central combination lock, which latches can be displaced manually into a release position.

This displacement can be blocked by a blocking part of the combination lock when the combination of the lock is improperly set. This blocking part is displaceable into the release position under spring action.

Such a development is known from U.S. Pat. No. 4,094,392, in which each hook latch is seated on its own spring-loaded slide which bears a release handle on the end. The ends of the slides which face the central combination lock are bent off at an angle and cooperate with bent ends of the blocking part of the combination lock. If the combination is improperly set, the bent ends of the slides and blocking part enter into coupling engagement so that displacement of the slides by the release handles is not possible. In order to open the lock it is necessary to set the combination properly, whereupon the blocking part swings into the release position. The bent ends of the latter release the slides so that the latter can be moved by the release handles, the hook latches coming into release position. The valise can thus be opened. This arrangement, however, is inconvenient to operate, since both hands are always required in order to open the valise. Furthermore, there is the additional disadvantage that, if the combination has been improperly set, opening forces are transmitted directly into the component part of the combination lock.

The object of the invention is to develop a closure of the afore-mentioned type in a manner which is easy to produce and advantageous in use, having a central operation with a structural form favorable with respect to the transmission of forces, with only slight danger of damage to the combination lock.

SUMMARY OF THE INVENTION

In accordance with the invention there is provided a single push key which is adjacent the combination lock and is formed by the central section of a swing yoke which surrounds the combination lock in U shape, the arms of the yoke, close to their pivot points on the ends of the arms, acting on arms of angle levers, the angle levers with their other angle arms forming hook swing latches.

As a result of this arrangement there is obtained a closure of the above-indicated type which is of increased utilitarian value. Central actuation of the hook swing latches is now possible. This can be done with the use of a single hand. The well-proven construction of the combination lock can be retained. A compact structural form is obtained as a result of the swing yoke which surrounds the combination lock in U shape. If it is desired to open the valise, the correct combination is, first of all, set on the combination lock, as a result of which the blocking part enters into the release position under spring action. It is now possible to displace the swing yoke around the pivot points arranged on the end of the U arms. Together with this, the angle levers are acted on such that their hook swing latches come out of engagement and thus permit the opening of the lid of the valise. The number of structural parts of the closure which is formed in this manner can be kept small while obtaining inexpensive manufacture and a simple installation of the closure. If the combination is not properly set, the push key formed by the central section of the swing yoke strikes solely against the blocking part so that no damaging forces can be produced within the combination lock. Furthermore, favorable lever ratios can be obtained, which permit opening with the exertion of only a slight amount of force.

The central section of the swing yoke performs another function in the manner that the central section bears on its rear a valise-position safety lever. This safety lever is of such a nature that the lid can only be opened when the valise is in the proper position. If the valise is, for instance, in the carrying position, then the valise-position safety lever prevents any displacement of the swing yoke.

Another advantage resides in the fact that the central section of the swing yoke is provided on its rear with projections in front of which blocking flanks of a blocking ledge lie when the combination has not been properly set. The blocking ledge is attached by plug-detent connection to the blocking part of the combination lock, which blocking part is formed as a slide. This permits easy association of the slide with the blocking ledge of the permutation lock, which can be effected, for instance, after the installation of the combination lock.

Further advantages result from the fact that the combination lock and the push key are seated in a recess in the wall of the valise.

In this connection it is advantageous, from the standpoint of installation, that the housing of the combination lock be held by detent engagement within a recess near the bottom of the recess in the wall of the valise.

The fact that the blocking ledge is guided on the bottom of the recess in the wall of the valise provides advantages as to stability.

Another advantage resides in the fact that the angle lever, one arm of which forms the latch head, is seated on mounting pins which extend parallel to the edge of the lid and are arranged close to the pivot point of the swing yoke, on the opposite side of which pins, seen from the pivot point of the swing yoke, the pressure point of the U-yoke arm extends, a latch idle path being provided between the U-yoke arm and the angle lever. In this way, the lid of the valise can be closed when the combination is not properly set, the angle levers moving away from the pressure point of the U-yoke arm.

Structural parts are furthermore reduced in number in the manner that the arm of the angle lever which is acted on by the U-yoke arm is under the influence of a latch spring. The latter at the same time acts on the swing yoke so that the yoke need not be acted upon separately.

BRIEF DESCRIPTION OF THE DRAWINGS

Further advantages and details of the object of the invention are explained in further detail below on basis of an illustrative embodiment shown in the drawings, in which:

FIG. 4 is a section along the line IV—IV of FIG. 3;

FIG. 5 is a section along the line V—V of FIG. 3;

DETAILED DESCRIPTION OF THE PREFERRED EMBODIMENT

Figure 2:
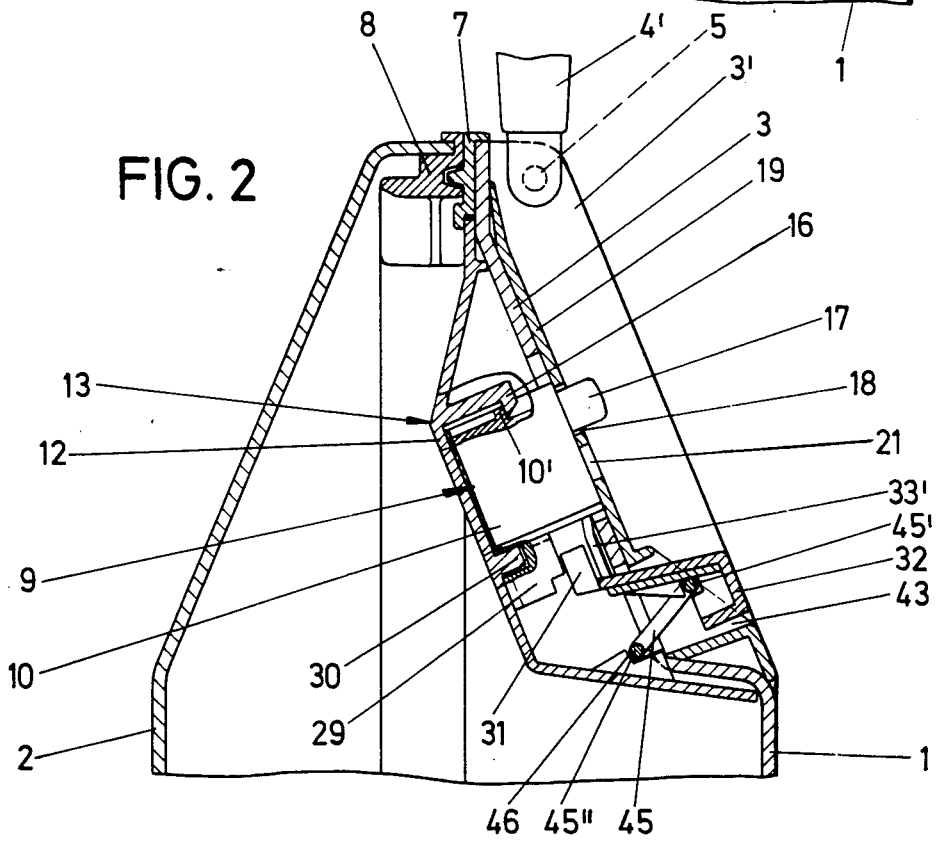
FIG. 2 is a section along the line II—II of FIG. 1.

The valise shown in the drawings has a shell-shaped valise lid 1 and a correspondingly shaped valise bottom 2. On the side opposite the hinge axis (not shown), the valise lid 1 and valise bottom 2 taper down. The valise lid 1 forms a central recess 3 in the tapering region. Between the side walls 3' of the recess there extend the arms 4' of a handle 4 of U shape. The ends of the arms 4' are traversed by pins 5 which, in their turn, enter into brackets 6. The latter are part of a sealing strip 7 which extends around the edge of the lid and form-interlocks with a sealing strip 8 which extends around the edge of the valise bottom 2; see in particular FIG. 2. The sealing strips 7, 8 can be attached, for instance, by adhesive, to the material of the valise lid and valise bottom respectively.

The recess 3 is sufficiently large so that the handle 4 can swing into a concealed position within it.

Within the region of the recess 3 there is a combination lock 9. Its housing 10 is engaged with the use of arms 11 in the region of the bottom 12 of a recess 3. The bottom 12 is formed by a cap 13 extending on the inner side of the valise, the cap being fastened in the region of the taper of the valise lid 1 to the latter by screws 14 which engage into projections 15 formed on the sealing strip 7. Detent projections 16 protrude from the bottom 12 and engage behind corresponding projections 10' on the housing 10.

Figure 8:
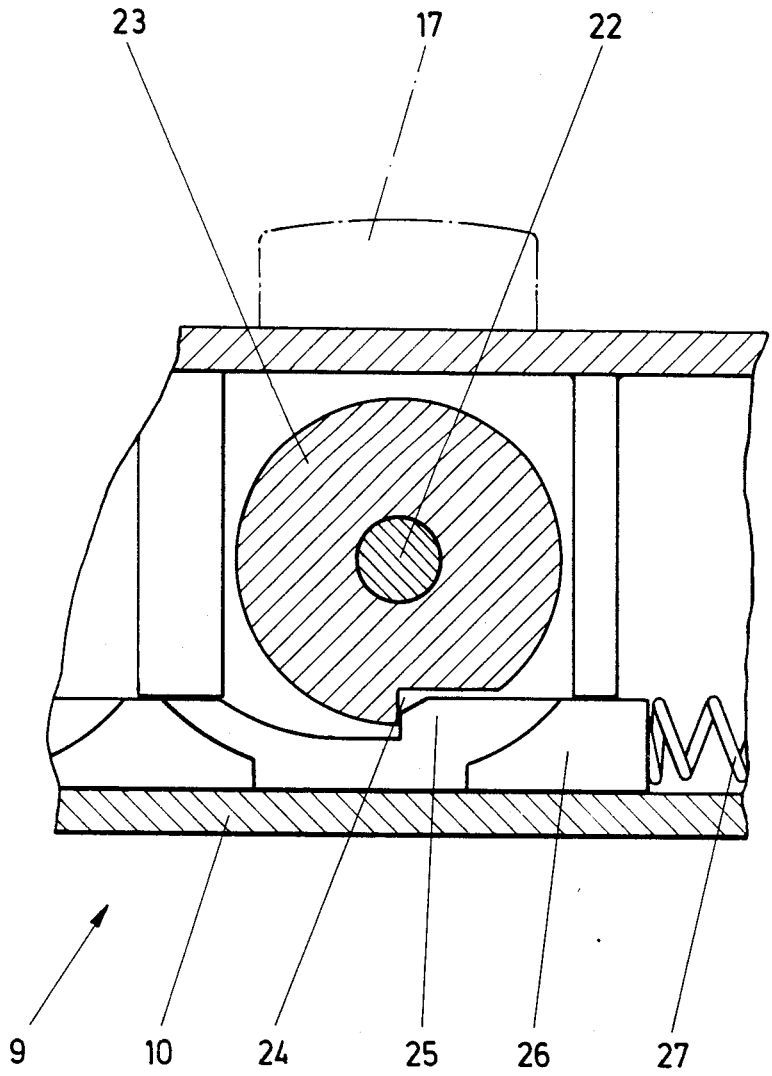
FIG. 8 is a section through the permutation latch in the region of a blocking sleeve, the section being perpendicular to the mounting axis of the blocking sleeve.

The combination lock 9 may comprise a push-key combination lock such as disclosed, for instance, in West German OS No. 3 038 481. Within the housing 10 there are three push keys 17 which pass through openings 18 in a cover plate 19 associated with the recess 3. The push keys 17, upon their displacement, turn disks 20 which bear numerical symbols and are located behind viewing windows 21 in the cover plate 19. These disks are turnable on mounting pins 22 which receive blocking sleeves 23 which are in coupling engagement with the disks 20. Each blocking sleeve 23 is provided on its edge with an engagement space 24, the engagement spaces cooperating with projections 25 of a slide 26 which forms the blocking part. A compression spring 27 acts on the slide 26 in such a manner that the projections 25 are urged into the engagement spaces 24 of the blocking sleeves 23. However, this is possible only when the combination of lock 9 has been properly set. In that case the slide 26 assumes the position shown in FIGS. 3 and 8. Transversely directed fingers 28 extend from the slide 26, a blocking ledge 29 being placed on said fingers 28 in the path of the plug-detent connection. The blocking ledge 29 extends over the bottom 12 of the recess. There the bottom forms a guide projection 30; see FIG. 2. The upper, free surface of the blocking ledge 29 forms blocking flanks in front of which projections 31 of a push key 32 lie. One end of the blocking ledge 29 is provided with a niche 29' which is adapted to the same shape as the projections 31. When the combination is properly set, the niche is aligned with one projection 31 of the push key 32 while the other projection 31, by suitable lengthwise dimensioning of the blocking ledge 29, can swing past the latter at its end.

Figure 1:
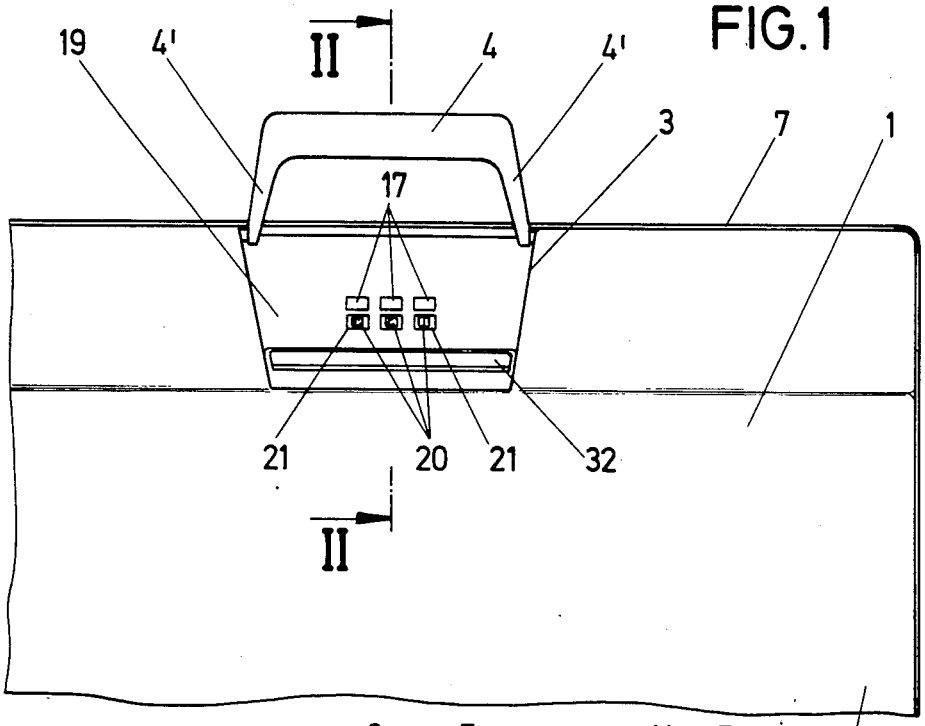
FIG. 1 is a partial view of a valise provided with such a closure including a combination lock.

The above-mentioned push key 32 is formed by the central section of a swing yoke 33 which surrounds the combination lock 9 in U shape and the arms 33' of which are mounted around pins 34 which, in their turn, are seated in brackets 35 of the cap 13. The arms 33' near their pivot points strike angle levers 36. Each angle lever 36 is turnable about two mounted pins 37 lying along the same axis, which extend parallel to the edge of the lid closely below the pivot point of the swing yoke. One arm 38 of the angle lever forms a hook swing latch which terminates in a latch head 39 which, in blocking position, engages behind a shoulder 40 of the valise bottom 2. The shoulder 40 is a part of the sealing strip 8, and extends within an engagement opening 41 formed on said sealing strip. A compression spring 42 which rests against the bottom 12 acts on the other arm of the angle lever 36 in such a manner that its stepped arm end 36' comes in front of the U-yoke arm 33' of the swing yoke 33. Its upward displacement is limited by the recess 3. Compression springs (not shown) urge the swing yoke 33 in an outward direction. The corresponding region of the cover plate 19 forms a passage opening 43 for the push key 32 (see FIGS. 1, 2 and 6). In the embodiment shown, the arm 38 of the angle lever 36, which arm terminates in the latch head 39, lies between the swing-yoke pivot point (pin 34) and the pressure point 44 of the U-yoke arm 33' and the angle lever 36; see in particular FIG. 4. The arm end 36' of the angle lever 36 is curved at this location.

Figure 3:
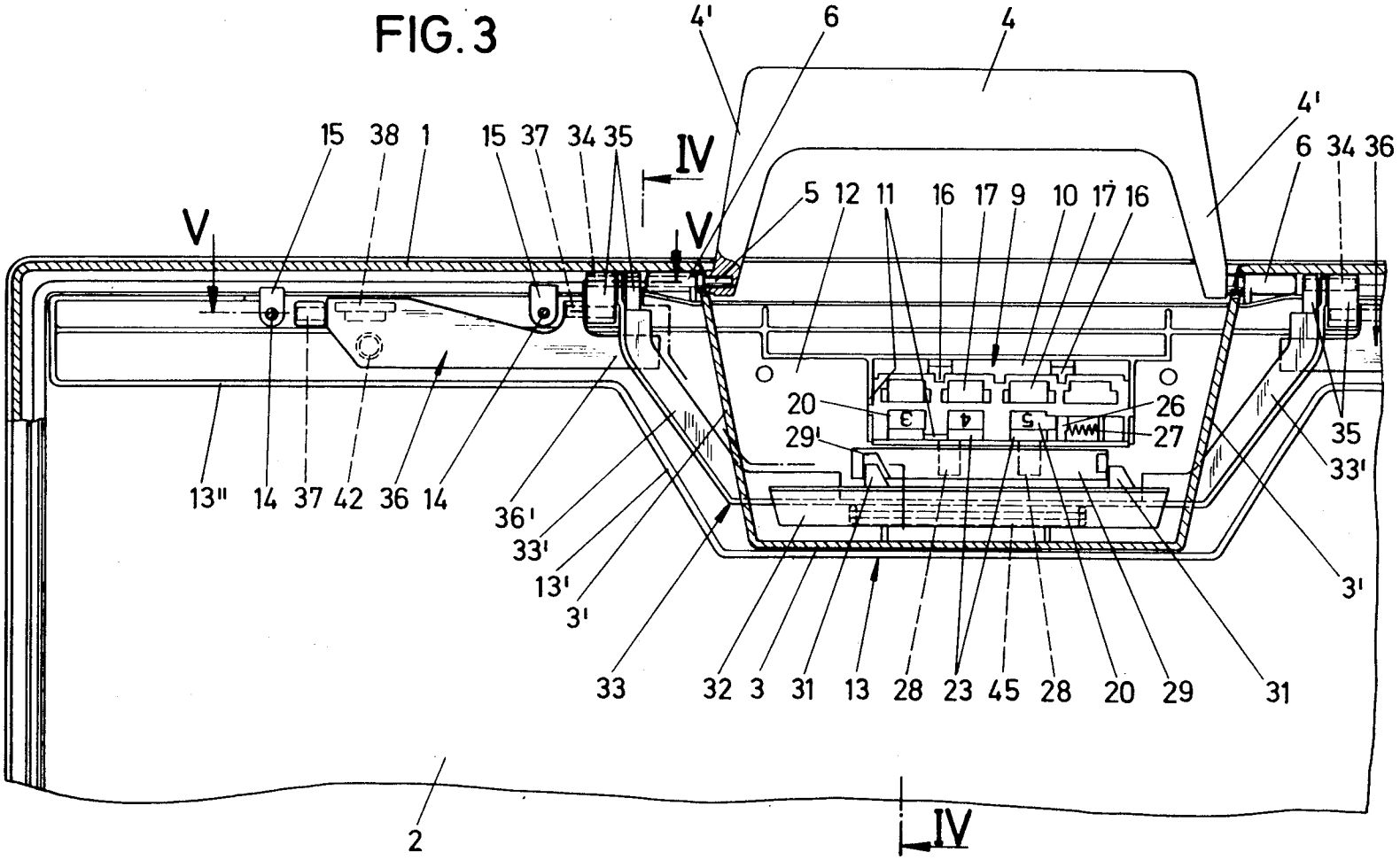
FIG. 3 is a longitudinal section through the valise of FIG. 1 in the region of the central recess, showing the combination lock with a combination properly set.

As can be noted from FIG. 3, the cap 13 fastened in the inside of the valise lid 1 has its greatest width in the region of the recess 3. From there it passes via a step 13' into narrower section 13'' over which the angle levers 36 extend.

On order that the valise lid 1 cannot be opened in all positions, a valise-position safety lever 45 is provided. The latter is formed as a frame, one frame arm 45' of which is swingably pivoted in the rear region of the central-section push key 32. A blocking step 46 extending from the cap 13 lies opposite the other frame arm 45''. The valise-position safety lever 45 acts by gravity. If the valise is in the carrying position shown in FIG. 2, the safety lever 45 comes in front of the blocking step 46. In such case the push key 32 cannot be actuated even if the combination has been properly set. The properly set combination has the result that the projections 31 of the push key 32 do not lie in the path of the blocking flanks of the blocking ledge 29. The valise-position safety lever 45 can also be formed as a solid injection molding of plastic.

Figure 6:
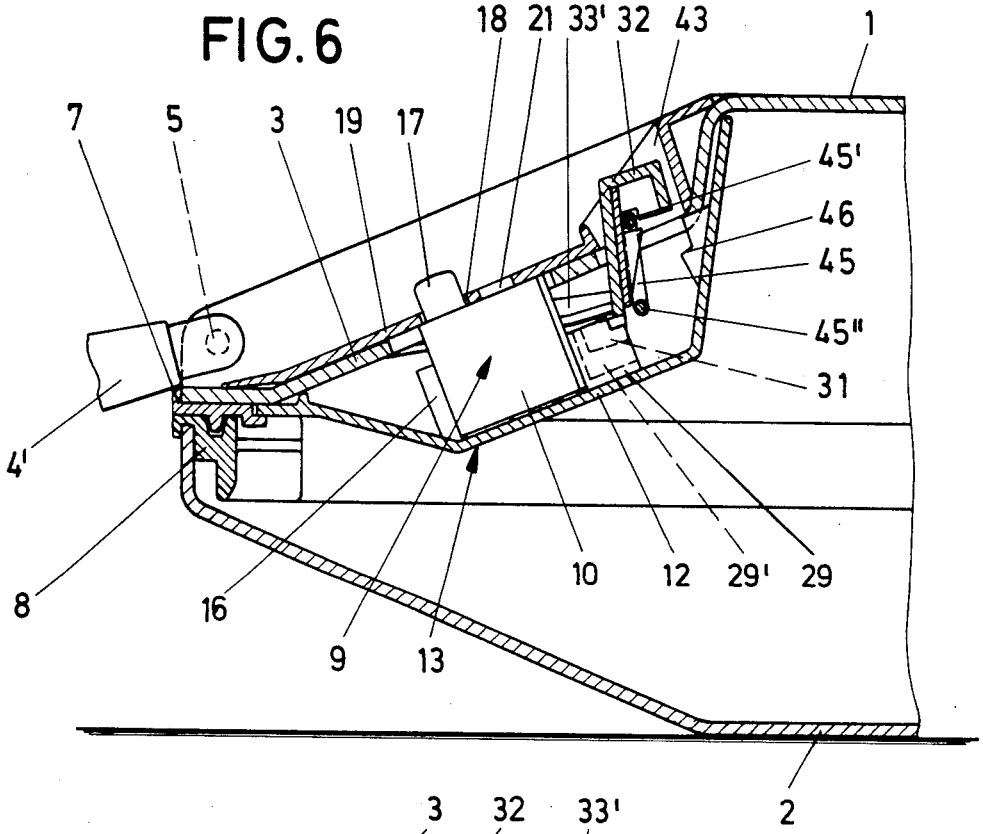
FIG. 6 corresponds to the view of FIG. 2, but with the bottom of the valise lying on a support and with the push key actuated.
Figure 7:
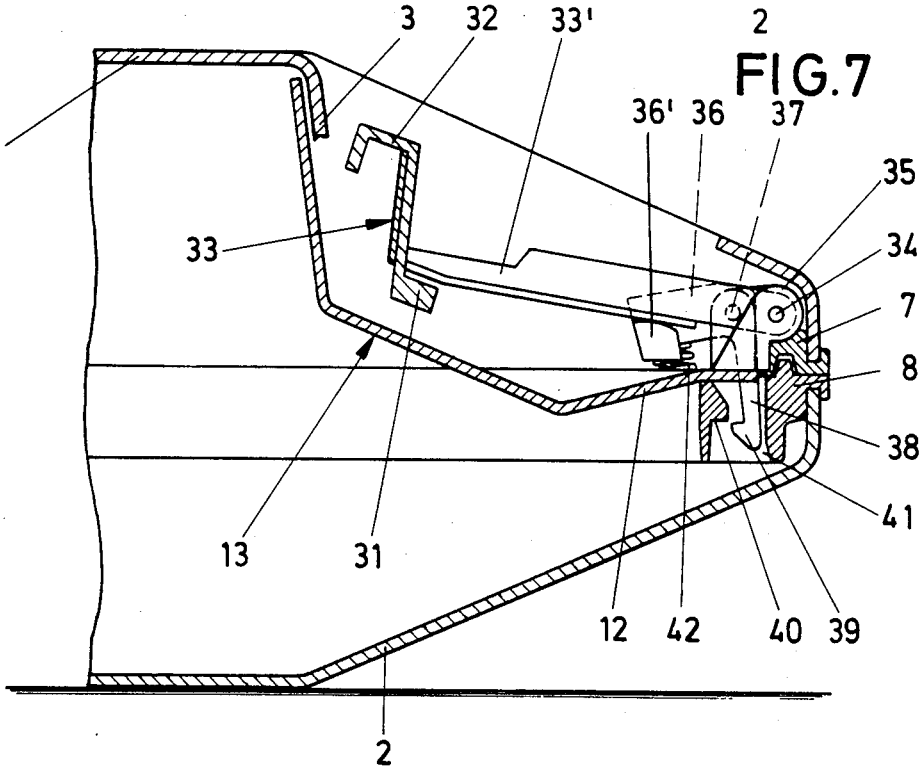
FIG. 7 corresponds to FIG. 4, but with the valise resting on a support, and showing the release position of the hook swing latch.

In order to open the valise lid 1, the position shown in FIG. 6 must be brought about. This means that the valise bottom 2 rests on a suitable support (indicated by the horizontal line at the bottom of FIG. 6). The safety lever 45 now moves away from the blocking step 46 as a result of gravity. The push key 32 can be displaced in inward direction, one of its projections 31 coming into the niche 29' of the blocking ledge 29 and its other projection 31 coming in front of the front side of the blocking ledge 29. By this displacement, as seen in FIG. 7, the U-yoke arms 33' strike the angle levers 36 and swing them against the action of the spring 42, the latch head 39 moving away from the blocking shoulder 40 of the bottom 2 of the valise. The valise lid 1 can then be opened.

After the push key 32 is released it returns into its basic position as a result of the spring-biased angle levers 36. Upon the closing of the lid of the valise, the angle levers 36 are duly swung as a result of the latch heads 39. The closing of the lid of the valise is possible even if the combination is not properly set, due to the latch idle-path between the U-yoke arm 33' and the angle lever 36.

If larger pushing forces are exerted on the push key 32 when the combination is not correctly set and the valise lid 1 is closed, then its projections 31 strike against the top blocking flanks of the displaced blocking ledge 29. These forces are, however, taken up by the bottom 12 of the cap and are not conducted into the mechanism of the combination lock 9.

If the shell-shaped lid part 1 is, for instance, to be given a greater thickness, the recess 3 should be so placed that it retains its angular position. The same closure mechanism can then be used without change.

We claim:

1. In a closure for a valise and the like, with hook latches on both sides of a central combination lock, the latches being displaceable by manual actuation into a release position, this displacement being blocked, when the combination of the lock is not properly set, by a blocking part of the combination lock which is displaceable into the release position by spring action, the improvement comprising:

a swing yoke surrounding the combination lock in U shape and having a central section and U-yoke arms with ends, each said end, respectively, having a pivot point, a manually actuatable single push key adjacent the combination lock, said single push key comprising said central section of said swing yoke, angle levers, each of said angle levers having a first arm and a second arm, each said first arm forming a hook swing latch, and respective ones of said U-yoke arms, adjacent said pivot point, operatively acting upon said second arm of a respective said angle lever.

2. The closure according to claim 1, further comprising a valise-position safety lever mounted on a rear of said push key.

3. The closure according to claim 2, wherein said safety lever constitutes means for blocking actuating movement of said push key when the valise is in an improper position for opening.

4. The closure according to claim 2, wherein said safety lever is movable by gravity to a position permitting actuating movement of said push key when a bottom of the valise is positioned on a support.

5. The closure according to claim 1, further comprising a blocking ledge having blocking flanks, said blocking part comprising a slide, said single push key having a center section provided on its rear with projections, said blocking flanks lying in front of said projections when the combination of said lock is improperly set, said blocking ledge being attached by plug-detent connection to said blocking part.

6. The closure according to claim 5, wherein said blocking ledge is cooperatable with a valise, said valise defining a recess therein, said blocking ledge extending on the bottom of said recess.

7. The closure according to claim 1, wherein said combination lock and said single push key are cooperatable with a valise comprising a wall defining a recess therein, said combination lock and said single push key being seated in the region of said recess.

8. The closure according to claim 7, wherein said valise further comprises a receiving cavity in the region of the bottom of said recess of said wall of said valise, and wherein said combination look further comprises a case, said case being engaged in said receiving cavity.

9. The closure according to claim 1, wherein said device is cooperatable with a valise, said valise comprises a lid, said hook swing latch of the first arm of each said angle lever defining a latch head on one end of said first arm, mounting pins, each said angle lever being seated on a respective of said mounting pin, each said mounting pin extends parallel to said lid and being arranged close to one of said pivot points of said swing yoke, a pressure point of at least one of said U-yoke arms extends on a side of said mounting pin opposite that of said pivot point, where a latch idle-path is defined between this said at least one U-yoke arm and a respective said angle lever.

10. The closure according to claim 1, further comprising a latch spring acts upon said second arm of at least one of said angle levers.

11. The closure according to claim 1, wherein each said second arm comprises a stepped arm end, said stepped end being operatively engaged by said respective ones of said U-yoke arms.

* * * * *